US005496487A

United States Patent [19]

Capeci et al.

[11] Patent Number: 5,496,487

[45] Date of Patent: Mar. 5, 1996

[54] AGGLOMERATION PROCESS FOR MAKING A DETERGENT COMPOSITION UTILIZING EXISTING SPRAY DRYING TOWERS FOR CONDITIONING DETERGENT AGGLOMERATES

[75] Inventors: Scott W. Capeci, North Bend, Ohio; David R. Nassano, Cold Springs, Ky.; Robert G. Welch, Cincinnati, Ohio

[73] Assignee: The Procter & Gamble Company, Cincinnati, Ohio

[21] Appl. No.: 296,764

[22] Filed: Aug. 26, 1994

[51] Int. Cl.[6] ..... C11D 11/00; C11D 17/06

[52] U.S. Cl. ..... 252/89.1; 252/135; 252/174; 252/174.23

[58] Field of Search ..... 252/89.1, 90, 174, 252/174.23, 135; 23/313 R, 313 FB

[56] References Cited

U.S. PATENT DOCUMENTS

| | | | |
|---|---|---|---|
| 1,157,935 | 10/1915 | Gray . | |
| 1,634,640 | 7/1927 | Zizinia . | |
| 2,004,840 | 6/1935 | Suchtelen | 159/4 |
| 2,900,256 | 8/1959 | Scott | 99/56 |
| 3,143,428 | 8/1964 | Reimers et al. | 99/141 |
| 3,148,070 | 9/1964 | Mishkin et al. | 99/71 |
| 3,354,933 | 11/1967 | Wengeler | 159/48 |
| 3,547,179 | 12/1970 | Hussmann | 159/4 |
| 3,626,672 | 12/1971 | Burbidge | 55/185 |
| 3,629,951 | 12/1971 | Davis et al. | 34/33 |
| 3,703,772 | 11/1972 | McHugh et al. | 34/9 |
| 3,842,888 | 10/1974 | Gibbons | 159/4 CC |
| 3,882,034 | 5/1975 | Gibbons | 252/99 |
| 4,005,987 | 2/1977 | Jury | 23/313 FB |
| 4,244,698 | 1/1981 | King et al. | 23/313 FB |
| 4,261,958 | 4/1981 | Pevzner et al. | 423/121 |
| 4,482,630 | 11/1984 | Allen et al. | 435/187 |
| 4,487,710 | 12/1984 | Kaminsky | 252/546 |
| 4,806,261 | 2/1989 | Ciallella et al. | 252/90 |
| 4,818,424 | 4/1989 | Evans et al. | 252/91 |
| 4,846,409 | 7/1989 | Kaspar et al. | 241/21 |
| 4,894,117 | 1/1990 | Bianchi et al. | 159/49 |
| 4,919,847 | 4/1990 | Barletta et al. | 252/558 |
| 4,946,653 | 8/1990 | Stopp et al. | 422/140 |
| 5,108,646 | 4/1992 | Beerse et al. | 252/174.25 |
| 5,133,924 | 7/1992 | Appel et al. | 264/342 R |
| 5,139,749 | 8/1992 | White | 422/200 |
| 5,160,657 | 11/1992 | Bortolotti et al. | 252/174.14 |
| 5,198,145 | 3/1993 | Lobunez et al. | 252/174.14 |
| 5,205,958 | 4/1993 | Swatling et al. | 252/174.13 |
| 5,366,652 | 11/1994 | Capeci et al. | 252/89.1 |

FOREIGN PATENT DOCUMENTS

| | | | |
|---|---|---|---|
| 118692 | 7/1944 | Australia | 28.6 36.4 |
| 0351937 | 1/1990 | European Pat. Off. | C11D 11/00 |
| 0451894A1 | 10/1991 | European Pat. Off. | C11D 10/04 |
| 0510746 | 10/1992 | European Pat. Off. . | |
| 1517713 | 7/1978 | United Kingdom | C11D 17/06 |

OTHER PUBLICATIONS

Naviglio and Moriconi, "Detergents Manufacture," *Soap/Cosmetics/Chemical Specialties,* Sep. 1987, pp. 34–37, 54–56.

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

The present invention provides a process which produces high density detergent compositions especially suitable for commercialization as a compact detergent product. The process can be easily retrofitted into existing spray drying detergent-making production plants in that it utilizes existing equipment so as to economize the transition from "tower" based to "non-tower" based detergent manufacturing plants. The process comprises the steps of: (a) agglomerating starting detergent ingredients in a mixer/densifier such that detergent agglomerates having a density of at least 650 g/l are formed; (b) conditioning the agglomerates in a spray-drying tower so as to enhance the free flowability of the detergent agglomerates: and (c) admixing adjunct detergent ingredients in the detergent agglomerates, thereby producing the high density granular detergent composition.

18 Claims, 2 Drawing Sheets

AGGLOMERATION PROCESS FOR MAKING A DETERGENT COMPOSITION UTILIZING EXISTING SPRAY DRYING TOWERS FOR CONDITIONING DETERGENT AGGLOMERATES

FIELD OF THE INVENTION

The present invention generally relates to a process for producing a high density detergent composition and, more specifically to an agglomeration process which utilizes existing spray drying towers for purposes of conditioning detergent agglomerates to enhance their flow properties for subsequent packaging and use in a granular detergent product. The process provides an especially useful and economical way in which existing "spray drying tower" detergent plants can be converted to "non-tower" agglomeration process plants.

BACKGROUND OF THE INVENTION

Recently, there has been considerable interest within the detergent industry for laundry detergents which are "compact" and therefore, have low dosage volumes. To facilitate production of these so called low dosage detergents many attempts have been made to produce high bulk density detergents, for example with a density of 600 g/l or higher. The low dosage detergents are currently in high demand as they conserve resources and can be sold in small packages which are more convenient for consumers.

Generally, there are two primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, porosity, particle size and surface area of the various starting materials and their respective chemical composition. These parameters, however, can only be varied within a limited range. Thus, a substantial bulk density increase can only be achieved by additional processing steps which lead to densification of the detergent granules.

There have been many attempts in the art for providing processes which increase the density of detergent granules or powders. Particular attention has been given to densification of spray-dried granules by post tower treatment. For example, one attempt involves a batch process in which spray dried or granulated detergent powders containing sodium tripolyphosphate and sodium sulfate are densified and spheronized in a Marumerizer®. This apparatus comprises a substantially horizontal, toughened, rotatable table positioned within and at the base of a substantially vertical, smooth walled cylinder. This process, however, is essentially a batch process and is therefore less suitable for the large scale production of detergent powders. More recently, other attempts have been made to provide a continuous processes for increasing the density of "post-tower" or spray dried detergent granules. Typically, such processes require a first apparatus which pulverizes or grinds the granules and a second apparatus which increases the density of the pulverized granules by agglomeration. These processes achieve the desired increase in density only by treating or densifying "post tower" or spray dried granules.

However, all of the aforementioned processes are directed primarily for densifying or otherwise processing "spray dried" granules. Currently, the relative amounts and types of materials subjected to spray drying processes in the production of detergent granules has been limited. For example, it has been difficult to attain high levels of surfactant in the resulting detergent composition, a feature which facilitates production of low dosage detergents. To alleviate such problems, the art and the industry have been addressing processes which entail agglomerating detergent compositions. For example, attempts have been made to agglomerate detergent builders by mixing zeolite and/or layered silicates in a mixer to form free flowing agglomerates. Other developments in this area of the art have provided agglomeration processes which ultimately result in fully formulated compact detergent compositions. As existing detergent plants which are fitted for spray-dried detergents are convened to the modem agglomeration process plants, a need has been identified for techniques and processes which can be easily and economically retro-fitted into such existing plants. It would therefore be desirable to have an agglomeration process for making detergent compositions which is more amenable and economical when implementing into existing spray-drying detergent plants.

Accordingly, there remains a need in the an to have an agglomeration process for continuously producing a high density detergent composition which facilitates conversion of existing spray-drying detergent plants to modem-day agglomeration process plants.

BACKGROUND ART

The following references are directed to densifying spray-dried granules: Appel et al, U.S. Pat. No. 5,133,924 (Lever); Bortolotti et al, U.S. Pat. No. 5,160,657 (Lever); Johnson et at, British patent No. 1,517,713 (Unilever); and Curtis, European Patent Application 451,894. The following references are directed to producing detergents by agglomeration: Beerse et at, U.S. Pat. No. 5,108,646 (Procter & Gamble); Hollingsworth et al, European Patent Application 351,937 (Unilever); and Swatling et al, U.S. Pat. No. 5,205,958.

SUMMARY OF THE INVENTION

The present invention meets the aforementioned needs in the an by providing a process which produces high density detergent compositions especially suitable for commercialization as a compact detergent product. The process can be easily retro-fitted into existing spray drying detergent-making production plants in that it utilizes existing equipment so as to economize the transition from "tower" based to "non-tower" based detergent manufacturing plants. In the instant process, conventional spray drying towers are used for purposes of conditioning detergent agglomerates produced by mixer/densifying equipment.

As used herein, the term "agglomerates" refers to particles formed by agglomerating more porous starting detergent ingredients (particles) which typically have a smaller mean particle size than the formed agglomerates. As used herein, the term "conditioning" refers to drying and/or cooling agglomerates to assist or enhance flow properties such as free flowability. All percentages and ratios used herein are expressed as percentages by weight (anhydrous basis) unless otherwise indicated. All documents are incorporated herein by reference. All viscosities referenced herein are measured at 70° C. (±5° C.) and at shear rates of about 10 to 100 $sec^{-1}$.

In accordance with one aspect of the invention, a process for producing a high density detergent composition is provided. The process comprises the steps of: (a) agglomerating starting detergent ingredients in a mixer/densifier such that detergent agglomerates having a density of at least 650 g/l are formed: (b) conditioning the agglomerates in a spray. drying tower so as to enhance the free flowability of the detergent agglomerates; and (c) admixing adjunct detergent ingredients in the detergent agglomerates, thereby producing the high density granular detergent composition.

In accordance with another aspect of the invention, another process is provided. This process comprises the steps of: (a) preparing an aqueous slurry of starting detergent ingredients in a crutcher; (b) agglomerating the starting detergent ingredients in a mixer/densifier such that detergent agglomerates having a density of at least 650 g/l are formed; (c) conditioning the agglomerates in a spray-drying tower so as to enhance the free flowability of the detergent agglomerates; and (d) admixing adjunct detergent ingredients in the detergent agglomerates, thereby producing the high density granular detergent composition. The detergent product produced by the aforedescribed process embodiments is also contemplated by the invention.

Accordingly, it is an object of the invention to provide a process for producing high density detergent compositions which are suitable for commercialization as a compact detergent. It is also an object of the invention to provide such a process which can be easily and economically retrofitted into existing "tower" based detergent-making plants. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

Figure 1:
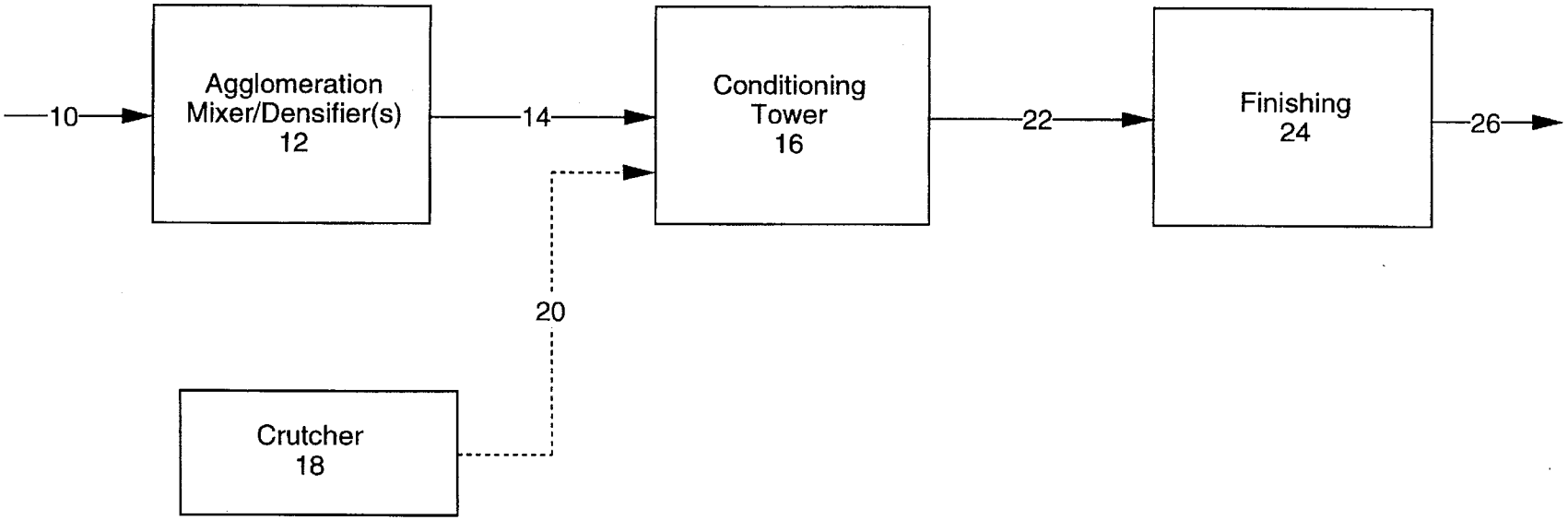
FIG. 1 is a flow diagram of a process in accordance with one embodiment of the invention in which conditioning of detergent agglomerates and spray drying are carried forth simultaneously in a spray drying tower.
Figure 2:
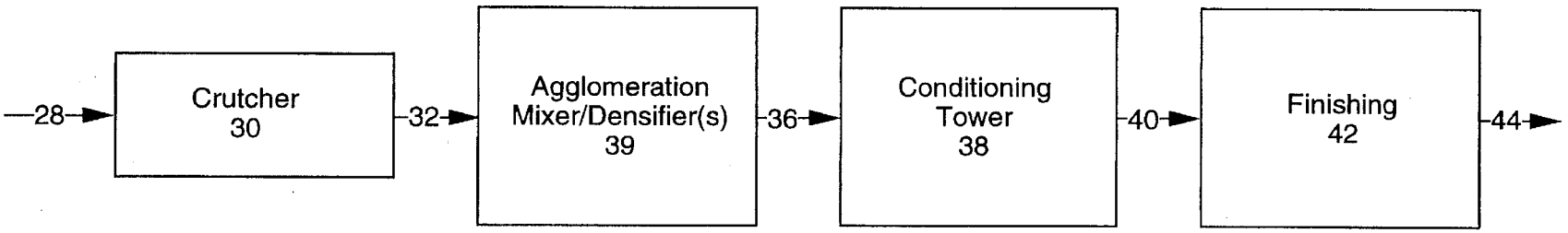
FIG. 2 is a flow diagram of a process in accordance with another embodiment of the invention in which agglomerating mixer/densifiers are inserted between the crutcher and spray drying tower so as to conveniently convert an existing detergent plant to a modern agglomeration detergent-making facility.

Reference can be made to FIGS. 1 and 2 for purposes of illustrating two embodiments of the process invention described herein. In each embodiment, the process is retrofitted such that a conventional spray drying tower is economically utilized to dry the resulting detergent agglomerates.

PROCESS

With specific reference to FIG. 1, the first step of the process entails agglomeration of starting detergent ingredients 10 in at least one, preferably two or more serially positioned mixer/densifiers 12. Preferably, mixer/densifiers will entail initially treating starting detergent ingredients 10 in a high speed mixer/densifier (not specifically shown in FIG. 1) and subsequently in a moderate speed mixer/densifier (not specifically shown in FIG. 1) so as to form detergent agglomerates 14. It should be appreciated that any variety of mixer/densifiers can be used as long as the desired agglomerates 14 are produced. For compact detergents, the resulting agglomerates 14 will generally have a density of at least 650 g/l or higher. Typical mixer/densifiers include but are not limited to treatment in a high speed mixer/densifier such as a Lödige Recycler CB-30 and then in a moderate speed mixer/densifier such as a Lödige Recycler KM-300 "Ploughshare". Other configurations may include conventional twin-screw mixers, mixers commercially sold as Eirich, Schugi, O'Brien, and Drais mixers, and combinations of these and other mixers. Residence times of the starting detergent ingredients 10 is such mixer/densifiers will vary depending on the particular mixer/densifier and operating parameters. The agglomerates 14 are then fed into a conventional spray drying tower 16 having a counter current or concurrent stream of air, generally from about 0° C. to about 400° C., such that the agglomerates 14 can be conditioned as they pass through tower 16. In this regard, conditioning may entail the step of drying the agglomerates 14 in tower 16 or cooling the agglomerates 14 depending upon the selected temperature of air passing through tower 16.

Optionally, a conventional crutcher 18 can be set up parallel to the mixer/densifiers 12 so that a crutcher mix of liquid detergent ingredients 20 may be fed into tower 16 simultaneously with the agglomerates 14 such that the liquid detergent ingredients 20 are spray dried into granules while the agglomerates are dried (conditioned) in tower 16. In this way, the throughput and flexibility of the process is increased. The liquid detergent ingredients 20 may include a variety of detergent ingredients, but preferably includes at least a detersive surfactant, builder and water. At the bottom of tower 16, agglomerates 14 and spray dried granules formed from the detergent ingredients 20 exit together in stream 22. The agglomerates 14 and granules in stream 22 are then subjected to one or more finishing steps 24 including but not limited to screening, grinding, cooling, admixing additional detergent ingredients, all of which enhance the characteristics of a fully formulated commercialized granular detergent product 26. Typically, the finishing step 24 will include at least a cooling step and or a drying step. Those skilled in the art will appreciate that a wide variety of methods may be used to dry as well as cool the exiting detergent agglomerates without departing from the scope of the invention. By way of example, apparatus such as a fluidized bed can be used for drying while an airlift can be used for cooling should it be necessary.

Reference is now made to FIG. 2 which illustrates another process embodiment of the invention in which starting detergent ingredients 28 are fed to a crutcher 30 so as to produce a fully mixed stream of liquid starting detergent ingredients 32 for input into agglomeration mixer/densifiers 34. As with the previously described process embodiment, the mixer/densifiers 34 produce detergent agglomerates 36 which are fed into a spray drying tower 38 such that they are subjected to a counter current flow of air (from about 0° C. to about 400° C.) for purposes of conditioning the agglomerates 36. The dried agglomerates 40 exiting the tower 38 are then subjected to one or more finishing steps 42 as described above, after which the fully formulated detergent product 44 is produced and ready for commercialization. This embodiment is easily retrofitted into the conventional spray drying detergent-making plants in that the mixer/densifiers can simply be inserted or "piped" between the existing crutcher 30 and tower 38 without removing or otherwise moving large equipment.

Optionally, the processes described in FIGS. 1 and 2 can comprise the step of spraying an additional binder in the mixer/densifiers 12 and 34 to facilitate production of the desired detergent agglomerates. A binder is added for purposes of enhancing agglomeration by providing a "binding" or "sticking" agent for the detergent components. The binder is preferably selected from the group consisting of water, anionic surfactants, nonionic surfactants, polyethylene glycol, polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional step contemplated by the present invention includes further processing the detergent agglomerates by adding a coating agent to improve flowability after they exit the mixer/densifiers 12 and 34 used in agglomeration or, in or between the selected mixer/densifiers used as the mixer/densifiers 12 and 34. For example, the coating agent can be added in the moderate speed mixer/densifier of a dual set-up as described previously in which a high speed mixer/densifier is followed by a moderate speed mixer densifier. Such coating agents can also be added further along the process, for example, during the finishing steps 24 and 42. This furthers enhances the condition of the detergent product streams 22 and 40 for use in the final detergent product 26 and 44. Preferably, the coating agent is selected from the group consisting of aluminosilicates, carbonates, silicates and mixtures thereof.

STARTING DETERGENT INGREDIENTS

The process of the present invention can incorporate a wide variety of detergent ingredients which ultimately form part of the finished detergent product. Preferably, the starting detergent ingredients include at least a surfactant paste, a detergent builder and optionally, an anhydrous material.

SURFACTANT PASTE

The viscous surfactant paste used in the process has a viscosity of from about 500 cps to about 100,000 cps, more preferably from about 5,000 cps to about 75,000 cps, and contains from about 5% to about 70% and, more preferably from about 10% to about 60%, by weight of water. As mentioned previously, the viscosity is measured at 70° C. and at shear rates of about 10 to 50 $sec.^{-1}$, preferably at 25 $sec.^{-1}$. Furthermore, the surfactant comprises from about 25% to about 95%, more preferably from about 30% to about 80% of a detersive surfactant, and the balance water and/or other conventional detergent ingredients.

The surfactant can be selected from anionic, nonionic. zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy. issued Dec. 16, 1980, both of which are also incorporated herein by reference. Of the surfactants, anionics and nonionics are preferred and anionics are most preferred.

The following are representative examples of detergent surfactants useful in the present surfactant paste. Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred anionic surfactants are $C_{10-18}$ linear alkylbenzene sulfonate and $C_{10-18}$ alkyl sulfate. If desired, low moisture (less than about 25% water) alkyl sulfate paste can be the sole ingredient in the surfactant paste. Most preferred are $C_{10-18}$ alkyl sulfates, linear or branched, and any of primary, secondary or tertiary. A preferred embodiment of the present invention is wherein the surfactant paste comprises from about 20% to about 40% of a mixture of sodium $C_{10-13}$ linear alkylbenzene sulfonate and sodium $C_{12-16}$ alkyl sulfate in a weight ratio of about 2:1 to 1:2. Another preferred embodiment of the detergent composition includes a mixture of $C_{10-18}$ alkyl sulfate and $C_{10-8}$ alkyl ethoxy sulfate in a weight ratio of about 80:20.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{15}$ alcohol condensed with about 6.5 moles of ethylene oxide per mole of alcohol.

Additional suitable nonionic surfactants include polyhydroxy fatty acid amides of the formula

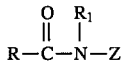

wherein R is a $C_{9-17}$ alkyl or alkenyl, $R_1$ is a methyl group and Z is glycidyl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965.576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980. incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville. Jr. et al., issued Feb. 3, 1976, the disclosure of which is incorporated herein by reference.

DETERGENT BUILDER

The starting detergent ingredients of the present process can, and preferably do, also comprise a detergent builder in an amount from about 1% to about 90%, more preferably from about 5% to about 70% and most preferably from about 10% to about 50% by weight. Builders are generally selected frown the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below). A specific preferred group of builders is selected from the group consisting of citrates, silicates, aluminosilicates and mixtures thereof.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, ultraconic acid and methylenemalonic acid. Some of these materials are useful as the water-soluble anionic polymer as hereinafter described, but only if in intimate admixture with the non-soap anionic surfactant.

Other suitable polycarboxylates :for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, convened to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

ANHYDROUS MATERIAL

Optionally, an anhydrous material may be used in the present process in an amount from about 1% to about 70%. more preferably from about 5% to about 50%, and most preferably from about 5% to about 20%. As used herein, the term "anhydrous material" means any hydratable material which is capable of absorbing water rapidly. Preferably, the anhydrous material is selected from the group consisting of carbonates, sulfates, carbonate/sulfate complexes, and mixtures thereof. While not intending to be limiting, other suitable anhydrous materials include powdered tripolyphosphate, powdered tetrasodium pyrophosphate, titrate, powdered carbonates such as calcium carbonate, powdered sulfates and mixtures thereof. Further, aluminosilicates disclosed in Corkill et al, U.S. Pat. No. 4,605,509 (Procter & Gamble), the disclosure of which is incorporated herein by reference, typically which have been over dried are suitable for use herein. Also, the anhydrous material can be selected from group consisting of absorbent gelling materials, cellulose-based materials and combinations thereof. Suitable absorbent gelling materials are disclosed in Brandt et al, U.S. Pat. Re. No. 32,649 (commonly assigned), the disclosure of which is incorporated herein by reference. Suitable cellulose-based materials are disclosed in Herron, U.S. Pat. No. 5,183,707 and Herron et al. U.S. Pat. No. 5,137,537, the disclosures of which are incorporated by reference. Most preferably, sodium carbonate, magnesium sulfate has been found to be effective in the process described herein.

ADJUNCT DETERGENT INGREDIENTS

The starting or entering detergent components in the present process can also include any number of additional ingredients or the process can include the step of admixing such ingredients in the finishing steps 24 and 42 shown in FIGS. 1 and 2, respectively. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference. In a preferred embodiment, the process admixes adjunct ingredients selected from the group consisting of bleaching agents, bleach activators, enzymes, polymeric anti-redeposition agents, polymeric dispersants, polymeric soil release agents, chelants, perfumes, dye transfer inhibitors and mixtures thereof.

Bleaching agents and activators are described in U.S. Pat. No. 4,412,934, Chung et al., issued Nov 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 throngh Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

This Example illustrates the process of the invention which produces free flowing, crisp, high density detergent composition. Two feed streams of various starting detergent ingredients are continuously fed, at a rate of 1400 kg/hr, into a Lödige CB-30 mixer/densifier, one of which comprises a surfactant paste containing surfactant and water and the other stream containing starting dry detergent material containing aluminosilicate and sodium carbonate. The rotational speed of the shaft in the Lödige CB-30 mixer/densifier is about 1400 rpm and the mean residence time is about 5–10 seconds. The contents from the Lödige CB-30 mixer/densifier are continuously fed into a Lödige KM-600 mixer/densifier for further agglomeration during which the mean residence time is about 6 minutes. The resulting detergent agglomerates are then fed to a 10 ft. diameter spraying tower (residence time 15—30 seconds. 200°–300° C.) and then to an airlift for cooling. An additional side stream of liquid detergent ingredients are fed from a conventional crutcher into the tower, as well. The crotchet mix contains a surfactant, a detergent builder, water and other adjunct detergent ingredients. The detergent agglomerate granules (wherein e ratio of granules to agglomerates is 60:40) are then screened with conventional screening apparatus and subjected to a grinding o ration resulting in a uniform particle size distribution. The composition of the detergent agglomerates exiting the airlift is set forth in Table I below:

TABLE I

| Component | % Weight |
|---|---|
| $C_{14-15}$ alkyl sulfate/alkyl ethoxy sulfate | 30.0 |
| Aluminosilicate | 37.8 |
| Sodium carbonate | 19.1 |
| Misc. (water, perfume, etc.) | 13.1 |
| | 100.0 |

Additional detergent ingredients including perfumes, brighteners and enzymes are sprayed onto or admixed to the agglomerates/granules described above in the finishing step to result in a fully formulated finished detergent composition. The relative proportions of the overall finished detergent composition produced by the process of instant process is presented in Table II below:

TABLE II

| Component | (% weight) |
|---|---|
| $C_{14-15}$ alkyl sulfate/$C_{14-15}$ alkyl ethoxy sulfate/$C_{12}$ linear alkylbenzene sulfonate | 29.2 |
| Polyacrylate (MW = 4500) | 2.7 |
| Polyethylene glycol (MW = 4000) | 0.6 |
| Sodium Sulfate | 6.7 |
| Aluminosilicate | 30.2 |
| Sodium carbonate | 25.0 |
| Protease enzyme | 0.3 |
| Lipase enzyme | 0.3 |
| Minors (water, perfume, etc.) | 10.0 |
| | 100.0 |

The density of the resulting detergent composition is 760 g/l, the mean particle size is 459 microns.

Having thus described the invention in detail, it will be obvious to those skilled in the art that various changes may be made without departing from the scope of the invention and the invention is not to be considered limited to what is described in the specification.

What is claimed is:

1. A process for producing a high density granular detergent composition comprising the steps of:

(a) agglomerating starting detergent ingredients by initially treating said starting detergent ingredients in a high speed mixer/densifier and subsequently in a moderate speed mixer/densifier so that detergent agglomerates having a density of at least 650 g/l are formed;

(b) conditioning said detergent agglomerates in a spray-drying tower so as to enhance the free flowability of said detergent agglomerates; and (c) admixing adjunct detergent ingredients in said detergent agglomerates, thereby producing said high density granular detergent composition.

2. The process of claim 1 wherein said starting detergent ingredients comprise a surfactant paste and a detergent builder.

3. The process of claim 2 wherein said surfactant paste has a viscosity of from about 500 cps to about 100,000 cps and contains from about 25% to 95%, by weight of said surfactant paste, of a detersive surfactant and the balance water.

4. The process of claim 2 wherein said detergent builder is selected from the group consisting of citrates, silicates, aluminosilicates and mixtures thereof.

5. The process of claim 2 wherein said starting detergent ingredients further include an anhydrous material selected from the group consisting of carbonates, sulfates, carbonate/sulfate complexes, cellulose-based materials and organic synthetic polymeric absorbent gelling materials.

6. The process of claim 1 further comprising the step of adding a coating agent in said moderate speed mixer/densifier, wherein said coating agent is selected from the group consisting of aluminosilicates, carbonates, silicates and mixtures thereof.

7. The process of claim 1 wherein said admixing step includes admixing adjunct ingredients selected from the following: bleaching agents, bleach activators, enzymes, polymeric anti-redeposition agents, polymeric dispersants, polymeric soil release agents, chelants, perfumes, dye transfer inhibitors and mixtures thereof.

8. The process of claim 1 further comprising the step of adding a stream of liquid starting detergent ingredients in said spray-drying tower so as to simultaneously form spray-dried detergent granules and dry said detergent agglomerates.

9. The process of claim 8 wherein said liquid starting detergent ingredients comprise a surfactant, a detersive builder and the balance water.

10. The process of claim 1 wherein said conditioning step comprises the step of drying said detergent agglomerates.

11. The process of claim 1 wherein said conditioning step comprises the step of cooling said detergent agglomerates.

12. A process for producing a high density granular detergent composition comprising the steps of:

(a) preparing an aqueous slurry of starting detergent ingredients in a crutcher;

(b) agglomerating said starting detergent ingredients by initially treating said starting detergent ingredients in a high speed mixer/densifier and subsequently in a moderate speed mixer/densifier so that detergent agglomerates having a density of at least 650 g/l are formed;

(c) conditioning said detergent agglomerates in a spray-drying tower so as to enhance the free flowability of said detergent agglomerates; and (d) admixing adjunct detergent ingredients in said detergent agglomerates, thereby producing said high density granular detergent composition.

13. The process of claim 12 wherein said starting detergent ingredients comprise a surfactant paste and a detergent builder.

14. The process of claim 13 wherein said surfactant paste has a viscosity of from about 500 cps to about 100,000 cps and contains from about 25% to 95%, by weight of said surfactant paste, of a detersive surfactant and the balance water.

15. The process of claim 13 further comprising the step of adding a coating agent in said moderate speed mixer/densifier, wherein said coating agent is selected from the group consisting of aluminosilicates, carbonates, silicates and mixtures thereof.

16. The process of claim 12, wherein said admixing step includes admixing adjunct ingredients selected from the following: bleaching agents, bleach activators, enzymes, polymeric anti-redeposition agents, polymeric dispersants, polymeric soil release agents, chelants, perfumes, dye transfer inhibitors and mixtures thereof.

17. A detergent product produced according to the process recited in claim 1.

18. A detergent product produced according to the process recited in claim 12.

* * * * *

UNITED STATES PATENT AND TRADEMARK OFFICE

CERTIFICATE OF CORRECTION

PATENT NO. : 5,496,487

DATED : March 5, 1996

INVENTOR(S) : Capeci et al.

It is certified that error appears in the above-indentified patent and that said Letters Patent is hereby corrected as shown below:

Under ABSTRACT, line 13, change "detergent agglomerates:" to --detergent agglomerates;

In Column 1, line 25, change "so called" to --so-called--.

In Column 1, line 52, change "spray dried" to --spray-dried--.

In Column 1, line 55, change "toughened, " to --roughened, --

In Column 2, line 17, change "convened" to --converted--.

In Column 2, line 18, change "modem" to --modern--.

In Column 2, line 25, change "an" to --art--.

In Column 2, line 28, change "modem" to --modern--.

In Column 2, line 36, change "at" to --al--.

In Column 2, line 39, change "at" to --al--.

In Column 2, line 47, change "an" to --art--.

UNITED STATES PATENT AND TRADEMARK OFFICE

CERTIFICATE OF CORRECTION

PATENT NO. : 5,496,487

DATED : March 5, 1996

INVENTOR(S) : Capeci et al

It is certified that error appears in the above-indentified patent and that said Letters Patent is hereby corrected as shown below:

In Column 2, line 58 change "porous starting" to --porous (interparticle) starting--.

In Column 2, line 59, delete "(particles)"

In Column 3, line 6, change "formed:" to --formed;--.

In Column 3, line 6, change "spray." to --spray--.

In Column 5, line 50 change"nonionic." to --nonionic,--.

In Column 5, line 58, change "Murphy." to --Murphy,--

In Column 8, line 9, change "1980." to --1980,--.

In Column 8, line 15, change "Baskerville." to --Baskerville,--.

In Column 8, line 25, change "frown" to --from--.

In Column 9, line 8, change ":for" to --for--.

In Column 9, line 19, change "vened" to --verted--.

In Column 9, line 27, change "O, being" to --O, M being--.

In Column 9, line 37, change "70%." to --70%,--.

In Column 9, line 46, change "titrate" to -- citrate--.

In Column 9, line 59, change "al." to--al--.

In Column 10, line 22, change "throngh" to--through--.

In Column 10, line 58, change "spraying" to --spray drying--.

In Column 10, line 59, change "15--30 seconds." to--15-30 seconds,--

In Column 10, line 62, change "crochet" to--crutcher--.

In Column 10, line 64, change "agglomerate granules (wherein e)" to --agglomerate/granules (wherein)--

UNITED STATES PATENT AND TRADEMARK OFFICE

CERTIFICATE OF CORRECTION

PATENT NO. : 5,496,487

DATED : Mar. 5, 1996

INVENTOR(S) : Scott W. Capeci, David R. Nassano, Robert G.Welch

It is certified that error appears in the above-indentified patent and that said Letters Patent is hereby corrected as shown below:

In Column 10, line 67, change "o ration" to --operation--.

In Column 12, line 10, delete "the".

In Column 12, line 11, delete "following:".

In Column 12, line 51, change "claim 13" to --claim 12--.

In Column 12, line 56, change "12," to --12--.

In Column 12, line 57, delete "the".

In Column 12, line 58, delete "following:".

Signed and Sealed this

Twenty-fourth Day of September, 1996

*Attest:*

Bruce Lehman

BRUCE LEHMAN

*Attesting Officer*

*Commissioner of Patents and Trademarks*